United States Patent [19]

Fukuma et al.

[11] 4,424,085

[45] Jan. 3, 1984

[54] COMPOSITE SOLID PROPELLANT CONTAINING FEOOH AS BURNING RATE MODIFIER

[75] Inventors: Daizo Fukuma, Sakado; Hisao Okamoto, Sayama, both of Japan

[73] Assignee: Nissan Motor Co., Ltd., Yokohama, Japan

[21] Appl. No.: 300,649

[22] Filed: Sep. 9, 1981

[30] Foreign Application Priority Data

Oct. 20, 1980 [JP] Japan ..... 55-146612

[51] Int. Cl.[3] ..... C06B 45/10

[52] U.S. Cl. ..... 149/19.1; 149/19.4; 149/19.9; 149/76; 149/83; 102/285; 102/289; 102/292

[58] Field of Search ..... 149/18, 19.1–19.4, 149/19.9, 76, 83; 102/285, 286, 287, 291, 292, 289

[56] References Cited

U.S. PATENT DOCUMENTS

| | | | |
|---|---|---|---|
| 3,834,956 | 9/1974 | Mellow et al. | 149/76 X |
| 3,933,543 | 1/1976 | Madden | 102/291 X |
| 3,954,531 | 5/1976 | Comfort | 149/76 X |
| 4,039,361 | 8/1977 | Ray et al. | 149/76 X |
| 4,114,591 | 9/1978 | Nakagawa | 149/37 X |
| 4,243,443 | 1/1981 | Utracki | 149/37 X |

*Primary Examiner*—Peter A. Nelson

*Attorney, Agent, or Firm*—Schwartz, Jeffery, Schwaab, Mack, Blumenthal & Koch

[57] ABSTRACT

The burning rate of a composite solid propellant comprising ammonium perchlorate and a fuel binder such as polysulfide, polyurethane or polybutadiene can remarkably be increased by the addition of a small amount of FeOOH. Considering the mechanical properties of the propellant, the maximum amount of FeOOH is preferably limited to 7 Wt % of the toatal of the fuel binder and ammonium perchlorate. It is possible to jointly use FeOOH and $Fe_2O_3$ on condition that the weight ratio of FeOOH to $Fe_2O_3$ is at least 10:90 and that the total weight of FeOOH and $Fe_2O_3$ is in the range from 0.9 to 7% of the total weight of the fuel binder and ammonium perchlorate.

13 Claims, No Drawings

COMPOSITE SOLID PROPELLANT CONTAINING FEOOH AS BURNING RATE MODIFIER

BACKGROUND OF THE INVENTION

This invention relates to a composite solid propellant which consists fundamentally of ammonium perchlorate and an organic fuel binder such as polysulfide, polyurethane or polybutadiene and contains iron oxide as a burning rate modifier.

In the field of composite solid propellants for various rocket motors, a continuing desire is to increase the burning rate. Needless to say, an increase in the burning rate of a solid propellant leads to an increase in the exhaust velocity of combustion gases in a rocket motor, and accordingly it becomes possible to increase the launching velocity of the rocket or to reduce the burning surface area where there is no need of increasing the launching velocity to thereby enhance the loading efficiency. In other words, solid propellants of increased burning rates are the basis of solid propellant rocket motors' relatively small size but relatively high thrust and will certainly contribute to broadening of the application of end-burning rocket motors.

It is an orthodox way of thinking to try to increase the burning rate of a composite solid propellant with little influences on the other properties of the propellant by using a certain additive that catalyzes the reaction between the oxidizer and fuel binder in the propellant. Until now various metal oxide powders have been proposed as the burning rate increasing additive or catalyst, but most of them are rather unsuitable of practical uses mainly because of significant tendencies to deterioration of their catalytic activity at the particles surfaces with the lapse of time. It is no exaggeration to say that only $Fe_2O_3$ has been put into practical use among the hitherto proposed metal oxide catalysts. However, it is quite difficult to increase the burning rate of a composite solid propellant by more than 100% by the addition of $Fe_2O_3$ because it is impossible to add an unlimitedly large amount of $Fe_2O_3$, which remains in the form of solid particles even after curing of the propellant, without significantly sacrificing the physical properties of the propellant. Besides, $Fe_2O_3$ also undergoes deterioration by aging to some extent.

Also it has been proposed to use a ferrocene derivative that is liquid at room temperature, e.g. di-n-butylferrocene, as a burning rate increasing catalyst. However, ferrocene derivatives are too expensive to use in rockets for commercial or scientific purposes. As another disadvantage, actual effects of the ferrocene derivatives on the burning rate are not so high as expected when considered relative to the amounts added to the propellants because these compounds are generally high in vapor pressure and highly volatile.

SUMMARY OF THE INVENTION

It is an object of the present invention to provide a composite solid propellant containing a burning rate increasing additive which is a solid and sufficiently stable material and is more effective than $Fe_2O_3$.

A composite solid propellant according to the invention comprises ammonium perchlorate as the oxidizer component and an organic fuel binder, and is characterized by further comprising FeOOH as a burning rate increasing additive. The burning rate of this propellant increases as the amount of FeOOH is increased, but the maximum amount of FeOOH is limited to 7% by weight of the total weight of the fuel binder and ammonium perchlorate in the propellant because the use of a larger amount of FeOOH may possibly hinder the mixing or kneading operation in the process of preparing the propellant and may possibly degrade the mechanical properties of the propellant.

We have discovered and confirmed that the burning rate increasing effect of FeOOH is higher than that of the same weight of $Fe_2O_3$ by about 25% and that it is possible to achieve more than a 150% increase in the burning rate of a polybutadiene base composite solid propellant for instance. Thus, an important advantage of our invention over the conventional propellants containing $Fe_2O_3$ as a solid catalyst is the possibility of remarkably increasing the burning rate without increasing the quantity of solid catalyst in the propellant and therefore without exerting unfavorable effects on the physical properties of the propellant.

It is within the scope of the present invention to jointly use FeOOH and $Fe_2O_3$. In the case of using FeOOH alone, i.e. without using $Fe_2O_3$, it is preferable that FeOOH amounts to at least 0.9% of the total weight of the fuel binder and ammonium perchlorate in the propellant. Where FeOOH and $Fe_2O_3$ are used jointly, it becomes a requisite that the weight ratio of FeOOH to $Fe_2O_3$ be not smaller than 10:90, and it is preferable that the total weight of FeOOH and $Fe_2O_3$ falls within the range from 0.9% to 7% of the total weight of the fuel binder and ammonium perchlorate.

Preferred examples of known fuel binders for use in the present invention are polysulfides, polyurethanes and polybutadienes.

Optionally, a propellant according to the invention may further comprise any one of the conventionally used additives for various purposes other than increase in the burning rate.

DESCRIPTION OF THE PREFERRED EMBODIMENTS

When FeOOH alone is used as the burning rate increasing additive for a composite solid propellant according to the invention, there are only a few more points to be added to the above explanation. Considering that FeOOH in the propellant works as a catalyst, it will readily be understood to use a fairly fine powder of FeOOH. It is preferred that the mean particle size of the FeOOH powder is smaller than about 1 $\mu$m. In preparing the propellant, FeOOH is introduced into the propellant composition at a suitable stage of the usual process of mixing ammonium perchlorate powder with a fuel binder and a curing agent, either at the start of the mixing process or at an intermediate stage.

In the present application, the term "fuel binder" should be taken as to include the curing agent, particularly where this term is used in specifying the amount of the burning rate increasing additive, which may be either FeOOH alone or FeOOH and $Fe_2O_3$.

FeOOH is commonly called goethite and can be regarded as $Fe_2O_3$ having water of crystallization since an alternative structural formula of this compund is $Fe_2O_3.H_2O$. $Fe_2O_3$ for use as a catalyst is usually prepared by firing $Fe(OH)_3$ to the extent of complete dehydration. By controlling the firing condition or firing duration of this process, it is possible to terminate the dehydration reaction at an intermediate stage so as to obtain either practically pure FeOOH or $Fe_2O_3$ containing a certain amount of FeOOH within the crystals. By X-ray diffraction analysis of the crystal structure of the product, FeOOH and $Fe_2O_3$ can be detected in distinction from each other.

The reason for a greater effect of FeOOH as a burning rate increasing catalyst than that of $Fe_2O_3$ has not yet fully been clarified. Considering that the catalytic effect of $Fe_2O_3$ is attributed to the so-called active points on its crystal surfaces and that $Fe_2O_3$ undergoes lowering of its catalytic activity by aging because the aforementioned active points tend to decrease as the crystal structure of $Fe_2O_3$ becomes stable, we will not fundamentally err if we presume the aforementioned reason in the following way. During combustion of a solid propellant containing FeOOH, fine particles of FeOOH present in the burning zone will instantaneously be dehydrated by the high temperature (usually 2500°–3000° C.) produced by combustion to form $Fe_2O_3$ which is abundant in the active points on the crystal surfaces, and this $Fe_2O_3$ will surely exhibit far higher catalytic activity than a $Fe_2O_3$ powder added to the propellant composition at the stage of preparing the composition.

When it is desired to use $Fe_2O_3$ together with FeOOH for economical or any other reason, it is important that the percentage of FeOOH to the total quantity of FeOOH and $Fe_2O_3$ be at least 10% by weight. If the proportion of FeOOH is less than 10% by weight, the joint use of FeOOH and $Fe_2O_3$ will not significantly be different in the burning rate increasing effect from the use of $Fe_2O_3$ alone. To fully gain the advantage of jointly using FeOOH and $Fe_2O_3$, it is preferred that FeOOH amounts to at least 20% by weight of the total quantity of FeOOH and $Fe_2O_3$. As described hereinbefore, a preferable range of the total weight of FeOOH and $Fe_2O_3$ is from 0.9 to 7.0% of the total weight of the fuel binder and ammonium perchlorate. Within this limitation, it is more preferable that FeOOH amounts to at least 0.3% by weight of the total quantity of the fuel binder and ammonium perchlorate from the viewpoint of attaining a relatively high effect on the burning rate. Where particularly great attention is paid to the mechanical properties of the propellant, it is preferred that the total weight of FeOOH and $Fe_2O_3$ does not exceed 5% of the total weight of the fuel binder and ammonium perchlorate.

A practical convenient way of jointly using FeOOH and $Fe_2O_3$ is to use a mixture of a FeOOH powder and a $Fe_2O_3$ powder. However, it is more favorable to use incompletely dehydrated $Fe_2O_3$ that contains a suitable amount of FeOOH within the crystals because, in a microscopic sense, $Fe_2O_3$ of such grade can be regarded as a more uniform mixture of FeOOH and $Fe_2O_3$ than a mixture of a FeOOH powder and a $Fe_2O_3$ powder.

EXAMPLE 1

As the oxidizer for a composite solid propellant, use was made of a mixture of 50 parts by weight of a relatively coarse powder (having a mean particle size of 250 μm) of ammonium perchlorate and 50 parts by weight of a relatively fine powder (having a mean particle size of 15 μm) of the same ammonium perchlorate. A fuel binder used in this example was a carboxyl-terminated polybutadiene (supplied from Japan Synthetic Rubber Co., Ltd.) added with a theoretical amount of a curing agent which was tris[1-(2-methyl)aziridinyl]phosphine oxide (commonly abbreviated to MAPO).

Under a reduced pressure of 10 mmHg or below, 80 parts by weight of the oxidizer and 20 parts by weight of the fuel binder were mixed with the addition of 1 part by weight of a very fine powder (having a mean particle size of 0.1 μm) of FeOOH.

The FeOOH powder was supplied from Toho Ganryo Kogyo Co., Ltd. under the tradename of ANCHOR FY-842. By X-ray diffraction analysis this powder was confirmed to be high purity FeOOH without the indication of the presence of $Fe_2O_3$. By colorimetric determination using o-phenanthroline, the content of FeOOH in this powder was 93.6%. In the impurity portion, Si could not be detected. The aforementioned amount (1 part) of the FeOOH powder refers to the net quantity of FeOOH. Actually, 100/93.6 parts by weight of the FeOOH powder was added to the mixture of the oxidizer and the fuel binder. The same applies to the amounts of FeOOH in the subsequent examples.

The propellant slurry obtained by the above mixing process was poured into a mold and cured by heating for a period of 150 hr at a constant temperature of 60° C. A resultant solid propellant block was cut into test pieces each in the shape of a cross-sectionally square rod which was 4 mm×4 mm in width and 100 mm in length, and the side surfaces of each test piece were restricted by the application of a paint containing inorganic heat-resistant fillers. To examine the burning rate of the solid propellant prepared in this example, the test pieces were each burned from one end surface in nitrogen gas atmosphere in a usual strand burner of the chimney type. An average burning rate measured at a pressure of 50 kg.f/cm$^2$ was 11.2 mm/sec. Also in the following Examples and References, the measurement of burning rate was performed in the same manner and under the same conditions.

REFERENCE 1A

A composite solid propellant was prepared generally in accordance with Example 1. As a sole modification, the addition of FeOOH was omitted without using any alternative additive, so that the propellant consisted of only the oxidizer and the fuel binder. The burning rate of this propellant was 5.5 mm/sec.

REFERENCE 1B

As a sole modification of Example 1, FeOOH was replaced by the same amount (1 part by weight) of $Fe_2O_3$, which was laboratory reagent of special grade in the form of a very fine powder having a mean particle size of 0.1 μm. The burning rate of the resultant solid propellant was 9.5 mm/sec.

EXAMPLES 2 to 4

Composite solid propellants were prepared generally in accordance with Example 1, but in these Examples the amount of FeOOH was varied to 3 parts by weight, 5 parts by weight and 7 parts by weight, respectively. For these Examples, the burning rates are shown in the following Table 1 together with the data for the following References.

REFERENCES 2 to 4

Composite solid propellants were prepared generally in accordance with Reference 1B, but in these References the amount of $Fe_2O_3$ was varied to 3 parts by weight, 5 parts by weight and 7 parts by weight, respectively.

TABLE 1

| | Propellant Composition | | | | |
|---|---|---|---|---|---|
| | $NH_4ClO_4$ (parts by Wt.) | CTPB & MAPO (parts by Wt.) | Burning Rate Increasing Additive (parts by Wt.) $Fe_2O_3$ | FeOOH | Burning Rate (mm/sec) |
| Reference 1A | 80 | 20 | — | — | 5.5 |
| Example 1 | 80 | 20 | — | 1 | 11.2 |
| Reference 1B | 80 | 20 | 1 | — | 9.5 |
| Example 2 | 80 | 20 | — | 3 | 12.6 |
| Reference 2 | 80 | 20 | 3 | — | 11.2 |
| Example 3 | 80 | 20 | — | 5 | 13.5 |
| Reference 3 | 80 | 20 | 5 | — | 12.1 |
| Example 4 | 80 | 20 | — | 7 | 14.0 |
| Reference 4 | 80 | 20 | 7 | — | 12.5 |

The physical properties of the solid propellants of the above Examples and References were also examined. As to the maximum tensile stress, elongation at maximum stress and elastic modulus in the initial state, it was confirmed that no statistically significant differences were produced by using FeOOH in place of the same amount of $Fe_2O_3$. That is, no statistically significant differences in the aforementioned items were observed between the propellants of Example 1 and Reference 1B, between the propellants of Example 2 and Reference 2, between the propellants of Example 3 and Reference 3 or between the propellants of Example 4 and Reference 4.

The following examples illustrate joint use of $Fe_2O_3$ and FeOOH, and the following Table 2 shows the burning rates of the propellants of these examples.

EXAMPLE 5

A solid propellant was prepared generally in accordance with Example 2, but 3 parts by weight of a mixture of 90 parts by weight of the aforementioned $Fe_2O_3$ powder with 10 parts by weight of the aforementioned FeOOH powder was used in place of 3 parts by weight of the FeOOH powder in Example 2.

EXAMPLES 6 and 7

These Examples were generally similar to Example 5, but the proportion of FeOOH to $Fe_2O_3$ was varied respectively. In Example 6, 3 parts by weight of a mixture of 80 parts by weight of the $Fe_2O_3$ powder with 20 parts by weight of the FeOOH powder was used, and in Example 7 the same amount of a 95:5 (by weight) mixture of the $Fe_2O_3$ powder to the FeOOH powder.

TABLE 2

| | Burning Rate Increasing Additive (parts by Wt. to 100 parts of oxidizer & fuel binder) | Composition of Burning Rate Increasing Additive $Fe_2O_3$ (Wt %) | FeOOH (Wt %) | Burning Rate (mm/sec) |
|---|---|---|---|---|
| Reference 2 | 3 | 100 | 0 | 11.2 |

TABLE 2-continued

| | Burning Rate Increasing Additive (parts by Wt. to 100 parts of oxidizer & fuel binder) | Composition of Burning Rate Increasing Additive $Fe_2O_3$ (Wt %) | FeOOH (Wt %) | Burning Rate (mm/sec) |
|---|---|---|---|---|
| Example 7 | 3 | 95 | 5 | 11.2 |
| Example 5 | 3 | 90 | 10 | 11.3 |
| Example 6 | 3 | 80 | 20 | 11.4 |
| Example 2 | 3 | 0 | 100 | 12.6 |

We claim:

1. A composite solid propellant comprising ammonium perchlorate as oxidizer, an organic fuel binder and FeOOH as a burning rate modifier.

2. A composite solid propellant according to claim 1, wherein the amount of said FeOOH is greater than zero and not larger than 7% by weight of the total quantity of said ammonium perchlorate and said fuel binder.

3. A composite solid propellant comprising ammonium perchlorate as the oxidizer, an organic fuel binder and FeOOH as a sole burning rate modifier, the amount of said FeOOH being greater than zero and not larger than 7% by weight of the total quantity of said ammonium perchlorate and said fuel binder.

4. A composite solid propellant according to claim 3, wherein the amount of said FeOOH is not smaller than 0.9% by weight of the total quantity of said ammonium perchlorate and said fuel binder.

5. A composite solid propellant according to claim 4, wherein said FeOOH is in the form of a fine powder having a mean particle size not larger than 1 $\mu$m.

6. A composite solid propellant comprising ammonium perchlorate as oxidizer, an organic fuel binder and a burning rate increasing additive which consists of FeOOH and $Fe_2O_3$, the weight ratio of FeOOH to $Fe_2O_3$ in said additive being not smaller than 10:90, the total weight of said additive being in the range from 0.9 to 7% of the total weight of said ammonium perchlorate and said fuel binder.

7. A composite solid propellant according to claim 6, wherein the weight ratio of FeOOH to $Fe_2O_3$ in said additive is not smaller than 20:80.

8. A composite solid propellant according to claim 6, wherein FeOOH in said additive amounts to at least 0.3% by weight of the total quantity of said ammonium perchlorate and said fuel binder.

9. A composite solid propellant according to claim 6, wherein the total weight of said additive is not greater than 5% of the total weight of said ammonium perchlorate and said fuel binder.

10. A composite solid propellant according to claim 6, wherein said additive is a mixture of a FeOOH powder and a $Fe_2O_3$ powder.

11. A composite solid propellant according to claim 6, wherein said additive is a $Fe_2O_3$ powder containing FeOOH in the crystals of $Fe_2O_3$.

12. A composite solid propellant according to claim 11, wherein said $Fe_2O_3$ powder is prepared by incomplete dehydration of $Fe(OH)_3$.

13. A composite solid propellant according to any one of claims 1, 3 and 6, wherein said fuel binder is selected from the group consisting of polysulfides, polyurethanes and polybutadienes.

* * * * *